US005615445A

United States Patent [19]

Kelsay et al.

[11] Patent Number: 5,615,445

[45] Date of Patent: Apr. 1, 1997

[54] TAPING KNIFE HANDLE

[75] Inventors: Curtis D. Kelsay, Springdale, Ark.; Alan J. Ness, Edgerton, Kans.

[73] Assignee: Marshalltown Trowel Company, Marshalltown, Iowa

[21] Appl. No.: 364,217

[22] Filed: Dec. 27, 1994

[51] Int. Cl.[6] ..... B25G 3/00

[52] U.S. Cl. ..... 15/245.1; 15/143.1; 15/235.4; 81/177.1

[58] Field of Search ..... 15/245.1, 235.4, 15/143.1; 16/111 R; 81/177.1

[56] References Cited

U.S. PATENT DOCUMENTS

| | | | |
|---|---|---|---|
| 31,436 | 2/1861 | Bisbee . | |
| 747,036 | 12/1903 | Bishop . | |
| 751,356 | 2/1904 | Smith . | |
| 2,410,572 | 11/1946 | Echikson | 15/143.1 X |
| 2,871,899 | 2/1959 | Coyle et al. | 81/177.1 |
| 3,018,497 | 1/1962 | Echikson | 15/143.1 |
| 3,078,491 | 2/1963 | Ames | 15/245.1 |
| 3,189,069 | 6/1965 | Stowell | 81/177.1 |
| 3,302,673 | 2/1967 | Forsberg . | |
| 4,381,579 | 5/1983 | Rumpp | 16/111 R |
| 4,452,289 | 6/1984 | Smith | 81/177.1 |
| 4,620,369 | 11/1986 | Gercken . | |
| 4,639,029 | 1/1987 | Kolonia | 294/57 |
| 4,729,271 | 3/1988 | Kenigson | 81/177.1 |
| 4,739,536 | 4/1988 | Bandera et al. | 16/111 R |
| 4,794,694 | 1/1989 | Daniel et al. . | |
| 4,837,892 | 6/1989 | Lo | 16/111 R X |
| 4,884,312 | 12/1989 | Clark | 15/235.4 |
| 4,941,232 | 7/1990 | Decker et al. | 16/111 R |

FOREIGN PATENT DOCUMENTS 2274615 8/1994 United Kingdom .

*Primary Examiner*—Chris K. Moore
*Attorney, Agent, or Firm*—McAndrews, Held & Malloy, Ltd.

[57] ABSTRACT

A taping knife which includes a blade with an elongated handle secured to the blade. The plastic handle includes a durable inner member and a grippable outer core. The hollow inner member is formed from adjoining member halves which have an inner structural support network of ribs. The handle component parts sealably interlock and are secured together upon formation of the outer grippable core whose material flows into certain ribbed network compartments and secures the interlocking parts together.

21 Claims, 4 Drawing Sheets

TAPING KNIFE HANDLE

BACKGROUND OF THE INVENTION

The present invention relates to a taping knife and more particularly to a taping knife having an ergonomically shaped handle formed of lightweight, yet strong, interlocking component parts. Furthermore, this invention accepts a hammer head that can be molded in place without the need for a fastener.

Taping knives, which have varying blade widths, are used to finish drywall construction projects and create a smooth transition between abutting drywall surfaces. After drywall boards are in place, a smaller (e.g. 4–6 inch) taping knife is generally used to apply a drywalling compound (often referred to as "mud") and drywall tape to the joints formed by the abutting drywall surfaces. At this stage, unseated nails must also be finally set into the boards. After the mud dries, progressively larger (e.g. 8 inch–14 inch) knives are used to apply more mud to the joint areas. This step is repeated until the joint is sufficiently flat and smooth.

A firm grip upon the handle of a taping knife is advantageous to prevent the knife from turning or slipping when smoothing mud or when its handle end is being used to sink nails. Present taping knives often use plastics, such as glass-filled nylons, polyolefins, or wood, for the handle. However, the low coefficient of friction on the smooth outer surface of the handle allows slippage of the trowel in the user's hand, particularly where the hand becomes wetted from perspiration or mud.

When taping knives are used to spread mud, the user tends to grasp the body of the handle with three to five fingers. The index and middle fingers are often extended forward, towards or resting on the blade, for added control of the angle and pressure of the blade's working face as presented to the work surface. The user's fingers and palm are prone to become chapped and may develop callouses wherever slippage or chafing occurs between the handle and the hand. A major factor promoting callousing of the hand is the presence of mud. Mud serves as an irritant by its abrasiveness as well as its chemical effect on the skin.

Present taping knives often use injection moldable plastics, such as glass-filled nylons or polyolefins, for the handle. However, when hollow plastic handles are used, watertight seals must be maintained around the joints in the component plastic parts because the complete tool is often submerged in water for cleaning. If water leaks into the handle's hollow cavities, then the weight advantage of a hollow structure may be reduced significantly. Often the manufacturing and final assembly processes, to achieve the necessary tolerances for proper handle assembly with watertight seals, become complex and expensive.

SUMMARY OF THE INVENTION

Therefore, it is an object of the present invention to overcome the deficiencies of prior art taping knives which make use of solid plastic, metal, wood or other handle materials, or which make use of hollow materials with expensive or ineffective component part seals.

It is a further object of the present invention to provide a taping knife with a grippable, non-slip outer surface.

It is a further object of the present invention to provide a taping knife which utilizes the outer grippable material to secure the assemblage of the handle's component parts.

It is a further object of the present invention to provide an improved taping knife in the combination of handle, the backing-plate and blade.

These and other objects are achieved in a taping knife having a lightweight, hollow handle with interlocking parts and inexpensive watertight seals.

In one embodiment, the handle is ergonomically shaped to fit the user's hand. The handle consists of lightweight, yet strong, component parts. The parts include an inner member of hollow adjoining halves with inner structural ribs, a protruding ridge on one half which is received by recessed groove on the opposite half, an endcap, a hammering head, and an outer grip member. The outer grip member surrounds areas of maximum exposure to the user's hand, secures the hammering head against the endcap, and seals the inner member assembly.

In one embodiment the handle can be injection molded from two separate types of plastic, where the outer hand grip is molded from a thermoplastic rubber having a slightly soft, non-slip, rubber-like surface which provides a favorable grippability to the handle and added ergonomic comfort for the user. The inner member of the handle, as molded from a harder, stronger plastic, provides inner strength for mounting the knife blade and subsequently using the tool.

In one embodiment, an inner member can be formed from polypropylene which provides a strong, durable, and resilient blade mounting surface. The friction of the polypropylene, relative to the friction of the outer hand grip, can be controlled by varying the finish on the exposed portions of the inner member.

DESCRIPTION OF THE PREFERRED EMBODIMENT

Figure 1:
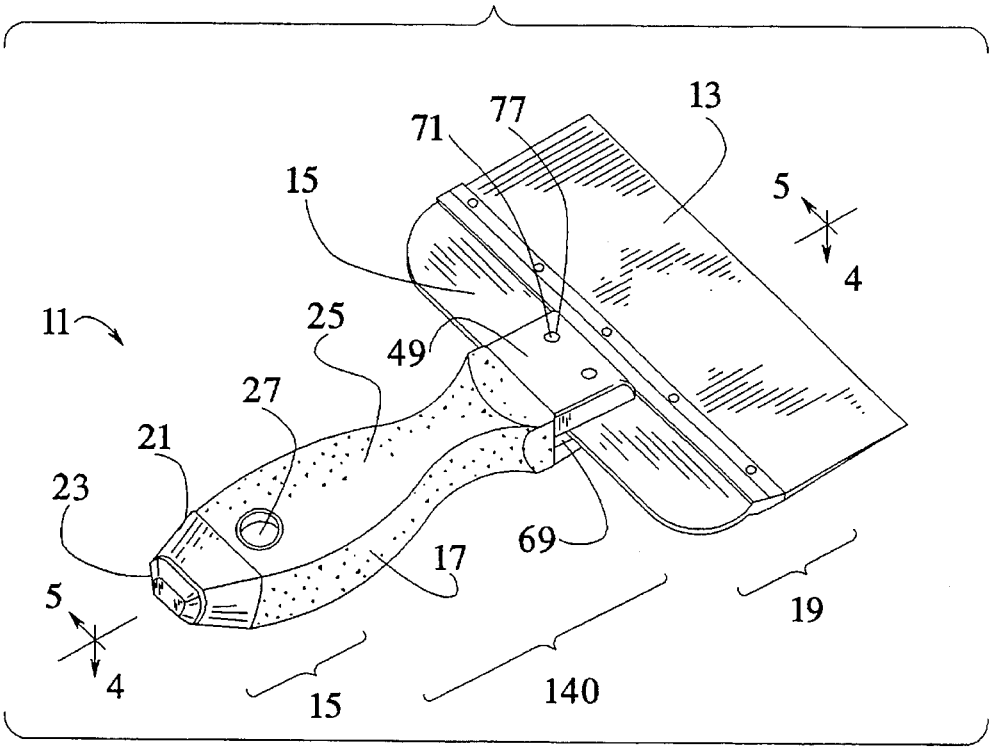
FIG. 1 is a perspective view of a taping knife embodiment of the present invention.
Figure 2:
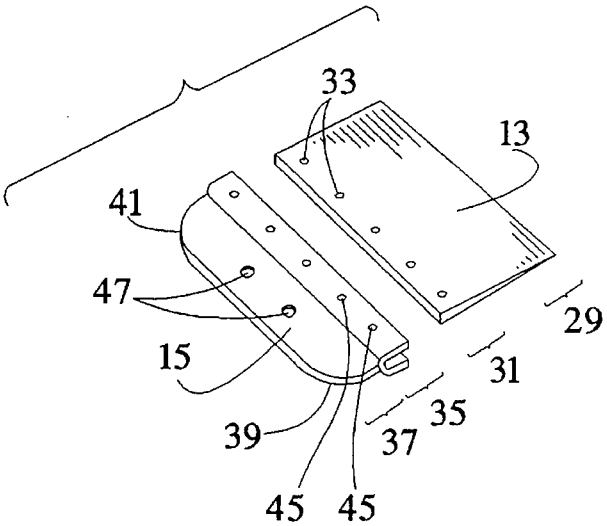
FIG. 2 is an exploded view of the taping knife blade and backing plate.
Figure 3:
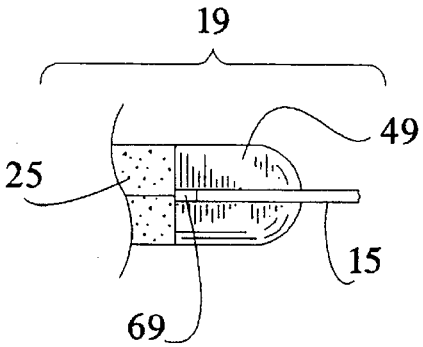
FIG. 3 is a side view of the proximal blade securement region of the taping knife handle.
Figure 4:
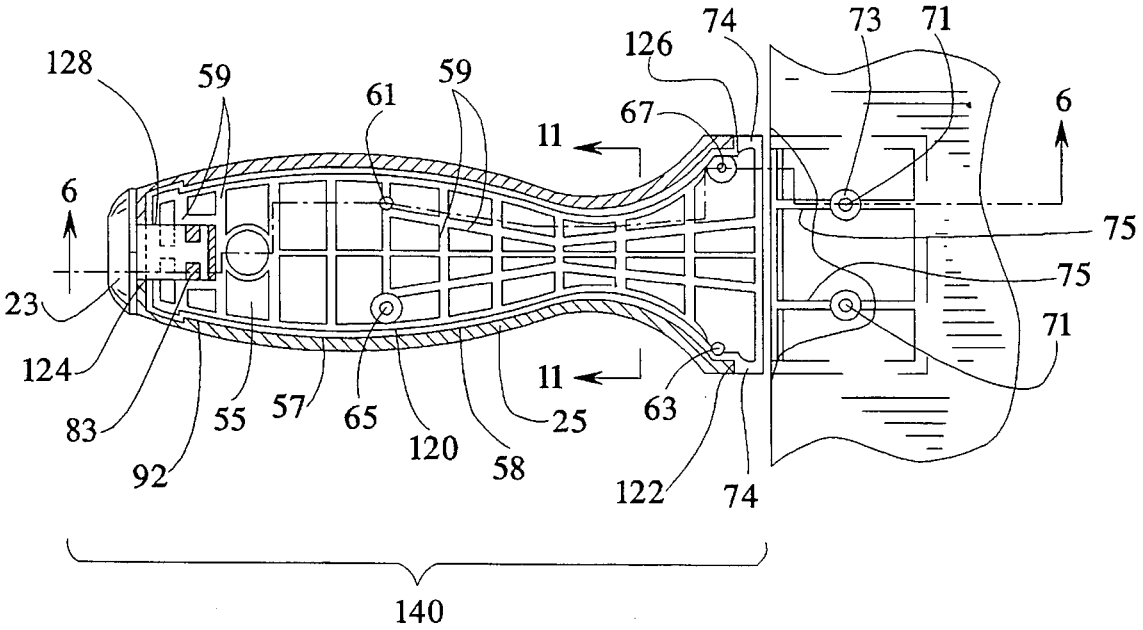
FIG. 4 is a 3—3 cross sectional view of the taping knife of FIG. 1.
Figure 5:
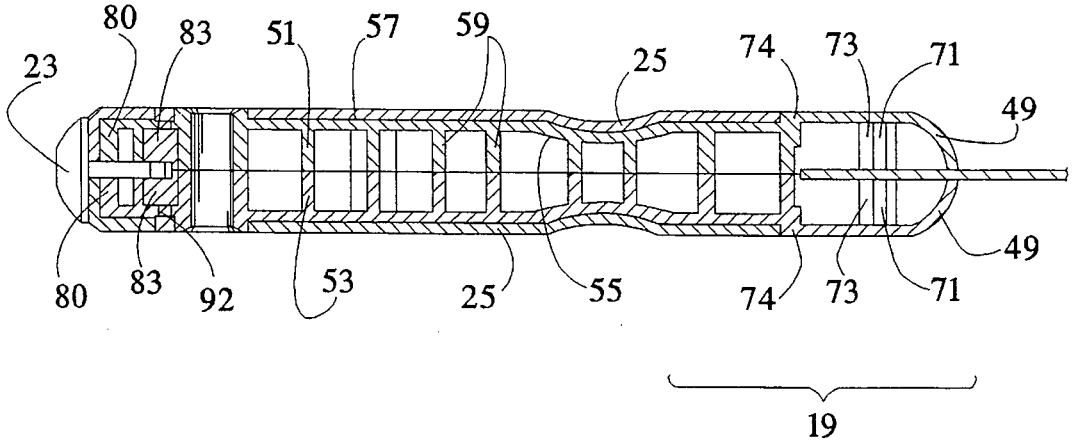
FIG. 5 is a 6—6 cross sectional view of the taping knife of as shown in FIG. 4.

Referring to FIG. 1, a taping knife 11 is constructed of a flat metal blade 13, a backing-plate 15, and a handle 17. Handle 17 is ergonomically shaped and comprised of a proximal blade securement region 19, a distal region 15, a distal endcap 21, a hammering head 23, an outer grip member 25, and a grippable portion 140. Outer grip member 25 provides a soft, grippable, rubber-like material in areas of maximum exposure to the user's hand, forming grippable areas. A hanging hole 27 extends through handle 17 and provides space for a cord, thong, or string (not shown) to be threaded though hole 27. Alternatively, hanging hole 27 may be threaded over a hanging bracket for sales viewing or for storage. Referring to FIG. 2, blade 13 is rectangular in shape and has a thin dimension. A proximal section 29 of the blade is located nearest to the work surface (not shown) during blade use, and a distal section 31 of the blade provides an area for mounting to backing plate 15. Distal section 31 includes a series of five or more blade-mounting holes 33, spaced along the width of the blade. Backing-plate 15 includes a proximal section 35 which is of the same width as blade 13, and a distal section 37 which is curved at its corners 39, 41. Proximal section 35 is thicker than distal section 37 and terminates in a blade-receiving slot 43 for receiving distal section 31 of blade 13. Slot 43 bifurcates proximal section 35 of backing-plate 15 along its entire length. Slot 43 extends deep enough distally within section 35 to receive and encompass blade-mounting holes 33. A stamping operation is used to force portions of section 35 at the slot interface into blade-mounting holes 33, rigidly holding blade 13 to backing-plate 15. The stamping operation creates indentations 45. Distal section 37 of backing-plate 15 includes a pair of backing-plate holes 47 for use in mounting the backing plate to handle 17. Referring to FIGS. 1, 3 and 5 handle 17 is formed of an inner plastic core member 49 about which outer grip member 25 is formed. As shown in FIGS. 4 and 5, core member 49 is integrally molded as one piece with blade securement region 19.

As shown in FIG. 5, inner member 49 is comprised of two adjoining member halves 51, 53. Each half includes an inside surface 55, an outside surface 57, an outer wall 58, and a structural rib network 59 extending between the two inside surfaces 55 of each half 51, 53 so as to provide structural support to handle 17. The structural ribs 59 are integrally formed with the inside surface 55 of member halves 51, 53.

As shown in FIG. 4, outer wall 58 of member half 51 includes a centered, protruding ridge 120 which extends around the perimeter of outer wall 58 of member half 51. Ridge 120 extends from ridge end 122 distally to ridge end 124, and from ridge end 126 distally to ridge end 128. Outer wall 58 of member half 53 includes a corresponding centered, recessed groove 130 which extends around the perimeter of outer wall 58 of member half 53 (mirroring ridge 120 of FIG. 4).

Figure 11:
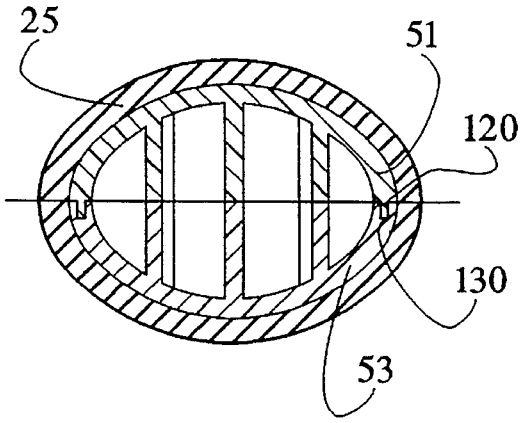
FIG. 11 is a 11—11 cross-sectional view of the adjoined inner member halves of the taping knife handle of FIG. 4.
Figure 12:
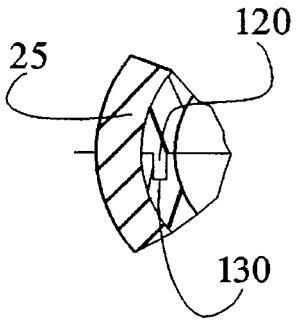
FIG. 12 is an enlarged cross-sectional view of the adjoined inner member halves of FIG. 11 where the protruding ridge of the outside wall ridge is received by the opposing recessed groove.

As further shown in FIG. 11, when member halves 51, 53 are joined, groove 130 receives ridge 120 to provide a seal around the perimeter of the joined member halves 51, 53. FIG. 12 shows an enlargement of the interlocking ridge 120 and groove 130.

Referring back to FIGS. 4 and 6 each member half 51, 53 also includes a pair of guide posts 61, 63 and a pair of corresponding guide receiver tubes 65, 67 which align with mirrored tubes and posts of the other member half. Posts 61, 63 and tubes 65, 67 further assure proper alignment and mating of the member halves 51, 53.

Referring again to FIGS. 1 and 3, blade securement region 19 of handle 17 terminates at its proximal end with a plate-receiving slot 69 for receiving backing-plate 15. As shown in FIGS. 1, 4 and 5, section 19 includes a pair of backing-plate fastening holes 71, which extend through both member halves 51, 53. As shown in FIGS. 4 and 5, holes 71 align with a pair of backing-plate fastening hole walls 73.

Referring to FIG. 4, inside surface 55 of each adjoining member half 51, 53 includes a least one structural rib 75 connecting axially with backing-plate fastening hole wall 73 for added support in mounting the combination of backing-plate 15 and blade 13.

Additionally, backing-plate fastening hole 71 aligns with backing-plate mounting hole 47 (FIG. 2) upon mounting of backing-plate 15 in plate-receiving slot 69. A rivet 77 (FIG. 1) secures backing-plate 15 to inner member 49. A first circumferential flange 74 extends from outside surface 57 of inner member 49 and is located in proximal blade securement region 19 where plate-receiving slot 69 terminates at its distal end.

Figure 6:
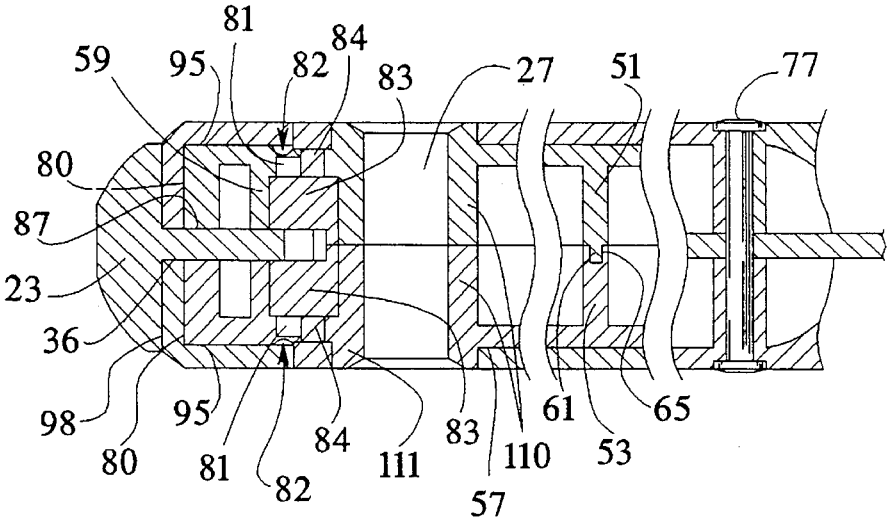
FIG. 6 shows enlarged portions of the 6—6 cross sectional of the taping knife handle as shown in FIG. 4.

Referring to FIGS. 4–6, inner member 49 terminates at its most distal end 15 in a flat surface 80. A second circumferential flange 81 extends from outside surface 57 of inner member 49 in distal region 15. As shown in FIG. 6, flange 81 has an outer surface 95 which extends proximally forward from flat surface 80 and parallels the proximally expanding shape of inner member 49. Flange 81 has a maximum outer diameter 82 (FIG. 6) at the most proximal end of flange 81.

Distal region 15 also includes at least one enclosed compartment 83 as formed from structural ribs 59 of inner member 49. Compartment 83 is formed proximally forward from surface 80 and lies substantially proximal of flange 81. At least one access hole 84 leads into each enclosed compartment 83 through outer surface 57 of member halves 51, 53. Surface 80 includes a first tongue-receiving slot 87 which extends proximally forward through structural ribs 59 and into compartment 83. Tongue-receiving slot 37 includes a proximal and a distal end.

Referring to FIG. 1 and FIGS. 4–7, an endcap 21 is formed of a plastic material which is the same as the material forming inner member 49. Endcap 21 includes an inner surface 90 and an outer surface 91. Endcap 21 also includes a proximal end 27, nearest to inner member 49, and a distal end 28.

Figure 7:
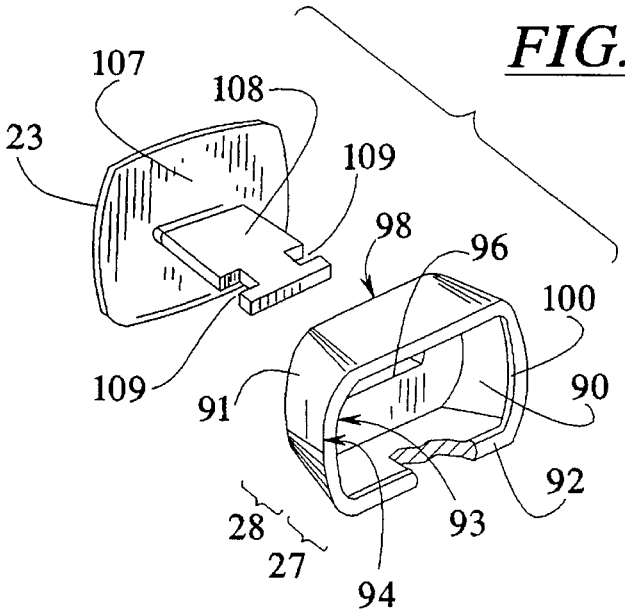
FIG. 7 is an exploded view of the handle endcap and hammering head components.

Referring to FIG. 7, endcap proximal end 27 terminates in an endcap wall 92 which has an inner diameter 93 and outer diameter 94. Inner diameter 93 is larger than maximum outer diameter 82 of flange 81. Endcap's inner surface 90 is substantially similar to flange outer surface 95 so that endcap 21 fits conformingly over flange surface 95. Endcap 21 also includes a lip 100 extending inwards around the circumference of inner surface 90, with lip 100 being flush with terminating endwall 92. Lip 100 hooks onto the proximal end of flange 81 and allows endcap 21 to lock into place, thus easing further assembly of handle 17. Referring to FIGS. 6 and 7, endcap 21 also includes a flat surface 98 terminating its distal end. Surface 98 includes a second tongue-receiving slot 96 which aligns with first tongue-receiving slot 87 of inner member 49.

Figure 8:
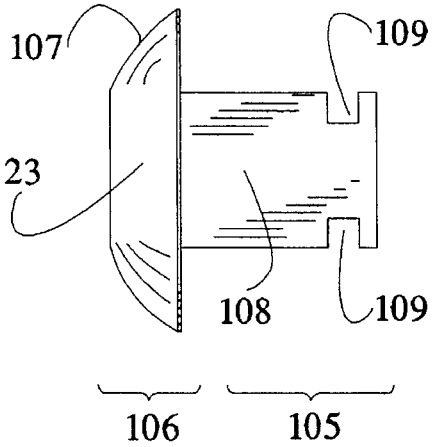
FIG. 8 is a side view of the hammering head component.
Figure 9:
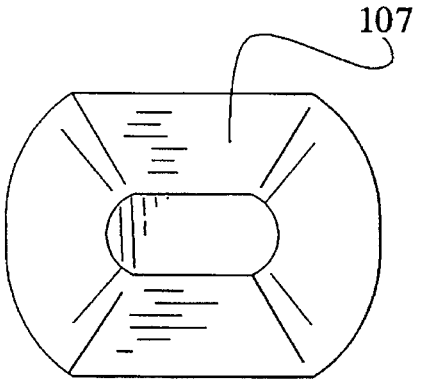
FIG. 9 is an top view of the hammering head component.
Figure 10:
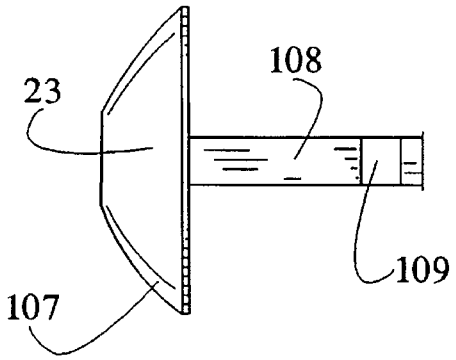
FIG. 10 is a end view of the hammering head component.

Referring to FIGS. 8–10, a hammering head 23 includes a proximal end 105, nearest to inner member 49, and a distal end 106. Hammering head 23 is usually formed from metal. Hammering head 23 includes a generally convex headcap 107 and a tongue 108 which extends proximally from headcap 107. Tongue 108 terminates proximally with notches 109 on each side of tongue 108. Referring to FIGS. 4–6, tongue 108 extends proximally a sufficient distance to place notches 109 inside contained compartment(s) 83 of inner member 49.

Referring again to FIG. 1 and FIGS. 4 and 5, outer grip member 25 extends from endcap wall 92 to first circumferential flange 74, where the material comprising grip member 25 abuts and seals against these surfaces. Also, upon formation of outer grip member 25, member 25 material flows into and is forced through access holes 84 which lead into enclosed compartment(s) 83. As a result, member 25 material fills compartment(s) 83 and encloses proximal end 105 of tongue 108 and tongue notches 109 (FIG. 6). Upon filling notches 109 and compartment(s) 83, member 25 material, when hardened, seals and secures hammering head 107 firmly against endcap 21, thus completing distal region 15 assembly of handle 17 without need for further adhesives or fasteners.

Referring again to FIGS. 4, 11 and 12, the sealing receipt of ridge 120 into groove 130 prevents outer grip member 25 material from flowing into unintended structural cavities. For instance, outer grip 25 material is intended to flow only into compartments(s) 83. Without the seal achieved by ridge 120 and groove 130 around the perimeter of inner member halves 51, 53, outer grip 25 material might leak, and/or be forcibly introduced, into hollow inner member 49. This would negate any weight advantages gained by using a hollow inner structure.

Referring to FIG. 6, hanging hole 27 is aligned with a hanging hole wall 110. Hole wall 110 terminates in an annular rim 111 which extends outward from outside surface 57 on each member half 51, 53. Outer grip member 25 surrounds and seals against rim 111, so as to provide a relatively flush surface for contact with the user's hand.

While only one preferred embodiment of the invention has been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A tapping knife, comprising:

a blade member having a working blade region and a blade securement region;

an elongated handle secured to said blade member in said securement region and extending distally from said blade member along the line of gripping, said handle including, (i) an inner member formed from a first plastic material, said inner member having distal and proximal ends; and (ii) an outer grip member formed of a second plastic material which surrounds a portion of said inner member to form a grippable area, said securement region including a backing plate secured to said blade and said handle being secured to said backing plate.

2. The taping knife of claim 1 wherein said blade includes a proximal end and a distal end, said proximal end including a blade-mounting hole, and wherein said backing-plate includes (i) a proximal end and distal end; and (ii) a blade-receiving slot which bifurcates lengthwise said proximal end of said backing-plate, said slot receiving said distal end of said blade and said slot extending to encompass said blade-mounting hole; and (iii) a stampable area adjacent said blade mounting hole which can be engaged with said blade-mounting hole to secure said blade to said backing plate; and (iv) at least one backing-plate mounting hole in said distal end of said backing-plate.

3. A taping knife, comprising:

a blade member having a working blade area and a blade securement region;

an elongated handle secured to said blade member in said securement region and extending distally from said blade member along the line of gripping, said handle having distal and proximal ends and further including, (i) a hollow inner member formed from a first plastic material, said inner member having distal and proximal ends and including two adjoining halves, each said half having an inside surface, an outside surface, and an outside wall; and (ii) a structural rib network on said inside surfaces of said inner member halves; and (iii) a hammering head formed from a hard, strong material having distal and proximal ends, said hammering head including a distal headcap and a tongue, said tongue extending proximally forward and including at least a pair of notches; and (iv) a slot in said distal end of said inner member for receiving said hammering head tongue; and (v) an outer grip member formed of a second thermoplastic rubber material which surrounds the grippable portion of said inner member; and (vi) at least one compartment formed by said structural ribs in said handle's distal end, said compartment including at least one access hole through said inner member halves, wherein (a) said tongue and said tongue notches extend proximally forward into said compartment; and (b) said outer grip material flows into and is forced through said compartment access holes, said material filling said inner member compartment and securely surrounding said hammering head tongue and said tongue notches.

4. The taping knife of claim 3 wherein said structural ribs are integrally formed with said inside surface of each said inner member half.

5. The taping knife of claim 4 wherein said grippable portion of one adjoining inner member half includes a protruding ridge, centered in said outside wall, which extends towards and is received by a recessed groove, centered in said outside wall of the opposite adjoining inner member half.

6. The taping knife of claim 7 wherein said securement region includes a backing plate secured to said blade and said handle secured to said backing plate.

7. The taping knife of claim 6 wherein said blade includes a proximal end and a distal end, said proximal end including a blade-mounting hole, and wherein said backing-plate includes (i) a proximal end and distal end; and (ii) a blade-receiving slot which bifurcates lengthwise said proximal end of said backing-plate, said slot receiving said proximal end of said blade and said slot extending to encompass said blade-mounting hole; and (iii) a stampable area adjacent said blade-mounting hole which can be engaged with said blade-mounting hole to secure said blade to said backing-plate; and (iv) at least one backing-plate mounting hole in said distal end of said backing-plate.

8. The taping knife of claim 7 wherein said inner member further includes a hole through said distal end for receiving a hanging means.

9. The taping knife of claim 8 wherein said hanging means includes a metal bracket.

10. The taping knife of claim 8 wherein said hanging means includes a flexible cord.

11. The taping knife of claim 8 wherein said handle further includes an endcap which fits over said adjoined inner member halves at said distal end.

12. The taping knife of claim 11 wherein said distal end of said inner member further includes a first circumferential flange on said outside surface for receiving said endcap.

13. The taping knife of claim 12 wherein said endcap further includes, (i) an inside surface and an outside surface; and (ii) a distal end and a proximal end; and (iii) a slot in its distal end which aligns with said inner member slot;

wherein said endcap terminates in an endcap wall, with said wall including a circumferential lip around said inside surface of the most proximal end of said wall, and wherein said lip snaps over said flange thereby holding said inner member halves together for further assembly.

14. The taping knife of claim 13 wherein said proximal end of said inner member further includes a second circumferential flange on said outside surface, wherein said outer grip material surrounds said adjoined inner member halves and abuts and seals against said second flange and said endcap wall in a flush manner with the user's hand.

15. The taping knife of claim 14 wherein said adjoining member halves form a blade-receiving slot which terminates said proximal end of said inner member, and said slot including (i) at least one backing-plate fastening hole through said inner member halves and said slot; and (ii) a supporting wall aligned around said hole; and (iii) at least one structurally supporting rib along said inside surface of each said inner member half, said rib extending axially and adjoining said hole supporting wall;

wherein said backing-plate mounting hole aligns with said backing-plate fastening through which a fastening means is used to secure said backing-plate to said inner member of said handle.

16. The taping knife of claim 15 wherein said fastening means is a rivet.

17. The taping knife of claim 15 wherein said blade fastening means includes a bolt and nut combination.

18. The taping knife of claim 11 wherein said endcap is formed of the same plastic material as said inner member.

19. The taping knife of claim 11 wherein said hammering head is formed of metal.

20. A taping knife, comprising:

a blade member having a working blade region and a blade securement region;

an elongated handle secured to said blade member in said securement region and extending distally from said blade member along the line of gripping, said handle including, (i) an inner member formed from a first plastic material, said inner member having distal and proximal ends; and (ii) an outer grip member formed of a second plastic material which is molded about a portion of said inner member to form a grippable area, said inner member including multiple component parts, said component parts being secured together by said outer grip member.

21. The taping knife of claim 20 and further including interlocking means for interlocking said component parts.

* * * * *

UNITED STATES PATENT AND TRADEMARK OFFICE

CERTIFICATE OF CORRECTION

PATENT NO. : 5,615,445

DATED : April 1, 1997

INVENTOR(S) : Kelsay et al.

It is certified that error appears in the above-identified patent and that said Letters Patent is hereby corrected as shown below:

Col. 6, line 47, delete "claim 7" and substitute therefor --claim 5--.

Signed and Sealed this

Nineteenth Day of October, 1999

*Attest:*

*Attesting Officer*

Q. TODD DICKINSON

*Acting Commissioner of Patents and Trademarks*

US005615445C1

(12) REEXAMINATION CERTIFICATE (4736th)

United States Patent

Kelsay et al.

(10) Number: US 5,615,445 C1

(45) Certificate Issued: Feb. 18, 2003

(54) TAPING KNIFE HANDLE

(75) Inventors: Curtis D. Kelsay, Springdale, AR (US); Alan J. Ness, Edgerton, KS (US)

(73) Assignee: Marshalltown Trowel Company, Marshalltown, IA (US)

Reexamination Request:
No. 90/006,012, May 18, 2001

Reexamination Certificate for:

| | |
|---|---|
| Patent No.: | **5,615,445** |
| Issued: | **Apr. 1, 1997** |
| Appl. No.: | **08/364,217** |
| Filed: | **Dec. 27, 1994** |

Certificate of Correction issued Oct. 19, 1999.

(51) Int. Cl.[7] ..... B25G 3/00

(52) U.S. Cl. ..... 15/245.1; 15/143.1; 15/235.4; 81/177.1

(58) Field of Search ..... 15/245.1, 143.1, 15/235.4, 145, 235.3, 236.01, 235.55, 235.6, 235.7, 238.8; 16/421, 430; 81/177.1; 30/342, 340, 344

(56) References Cited

U.S. PATENT DOCUMENTS

| | | | |
|---|---|---|---|
| 31,436 | A | 2/1861 | Bisbee |
| 404,667 | A | 5/1889 | Woodhouse et al. |
| 702,190 | A | 5/1902 | Ewing |
| 747,036 | A | 12/1903 | Bishop |
| 751,356 | A | 2/1904 | Smith |
| 1,153,575 | A | 9/1915 | Rowely |
| 1,694,559 | A | 12/1928 | Osgood |
| 1,813,797 | A | 7/1931 | Foley |
| 2,271,290 | A | 1/1942 | Echikson |
| 2,410,572 | A | 11/1946 | Echikson |
| 2,498,107 | A | 2/1950 | Ferguson |
| 2,837,381 | A | 5/1958 | Sarlandt |
| 2,871,899 | A | 2/1959 | Coyle et al. |
| 2,985,209 | A | 5/1961 | Novelo |
| 3,018,497 | A | 1/1962 | Echikson |
| 3,078,491 | A | 2/1963 | Ames |

(List continued on next page.)

FOREIGN PATENT DOCUMENTS

| | | |
|---|---|---|
| DE | 35 25 163 | 1/1987 |
| DE | 87 08 864 | 9/1987 |
| DE | 92 02 550.1 | 6/1992 |
| DE | 92 04 670.3 | 7/1992 |
| DE | 43 04 965 | 2/1993 |

(List continued on next page.)

OTHER PUBLICATIONS

Task Force Taping Knife Labels, Unknown.
Goldblatt Full–Line Catalog, 1992.
Stanley Industrial Tools, unknown.
Goldblatt Industrial Tools Catalog, Unknown.
Goldblatt Catalog, 1993.

(List continued on next page.)

*Primary Examiner*—Gary Graham

(57) ABSTRACT

A taping knife which includes a blade with an elongated handle secured to the blade. The plastic handle includes a durable inner member and a grippable outer core. The hollow inner member is formed from adjoining member halves which have an inner structural support network of ribs. The handle component parts sealably interlock and are secured together upon formation of the outer grippable core whose material flows into certain ribbed network compartments and secures the interlocking parts together.

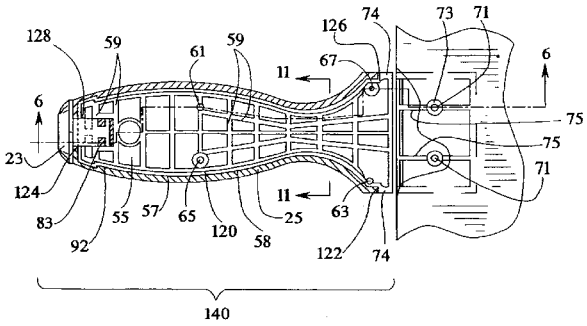

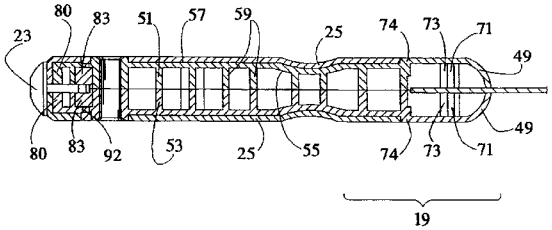

U.S. PATENT DOCUMENTS

| | | | |
|---|---|---|---|
| D196,709 | S | 10/1963 | Johnson |
| 3,173,462 | A | 3/1965 | Koeppel |
| 3,189,069 | A | 6/1965 | Stowell |
| 3,302,673 | A | 2/1967 | Forsberg |
| 3,520,059 | A | 7/1970 | Gringer |
| 3,712,659 | A | 1/1973 | Kneissl |
| 3,770,033 | A | 11/1973 | Gavillet et al. |
| 4,023,606 | A | 5/1977 | Kneissl |
| 4,316,302 | A | 2/1982 | Clark |
| 4,355,465 | A | 10/1982 | Besson |
| 4,381,579 | A | 5/1983 | Rumpp |
| 4,416,166 | A | 11/1983 | Jannard et al. |
| 4,452,289 | A | 6/1984 | Smith |
| 4,452,862 | A | 6/1984 | Markert et al. |
| 4,467,492 | A | 8/1984 | Harrington |
| 4,524,514 | A | 6/1985 | Mallalieu et al. |
| D284,537 | S | 7/1986 | Pashley et al. |
| 4,620,369 | A | 11/1986 | Gercken |
| 4,639,029 | A | 1/1987 | Kolonia |
| 4,712,304 | A | 12/1987 | Sanelli |
| 4,721,021 | A | 1/1988 | Kusznir |
| 4,729,271 | A | 3/1988 | Kenigson |
| 4,739,536 | A | 4/1988 | Bandera et al. |
| 4,794,694 | A | 1/1989 | Daniel et al. |
| 4,813,143 | A | 3/1989 | Scheminger et al. |
| 4,837,892 | A | 6/1989 | Lo |
| 4,841,638 | A | 6/1989 | Bardeen et al. |
| 4,884,312 | A | 12/1989 | Clark |
| 4,890,351 | A | 1/1990 | Wilson |
| 4,941,232 | A | 7/1990 | Decker et al. |
| 4,949,457 | A | 8/1990 | Burout, III |
| 4,951,533 | A | 8/1990 | Hillinger |
| 4,953,862 | A | 9/1990 | Uke et al. |
| 4,969,231 | A | 11/1990 | Mader et al. |
| 4,981,737 | A | 1/1991 | Rico |
| 5,008,970 | A | 4/1991 | Tsai |
| 5,067,889 | A | 11/1991 | Humiston |
| D327,623 | S | 7/1992 | Boche |
| 5,141,353 | A | 8/1992 | Meredith et al. |
| 5,155,878 | A | 10/1992 | Dellis |
| 5,211,669 | A | 5/1993 | Bonnes et al. |
| 5,253,557 | A | 10/1993 | Dolak |
| 5,261,144 | A | 11/1993 | Mitchell et al. |
| 5,390,572 | A | 2/1995 | Gakhar et al. |
| 5,446,941 | A | 9/1995 | Kelsay |
| 5,522,111 | A | 6/1996 | Kelsay et al. |
| 5,530,989 | A | 7/1996 | Remmert et al. |

FOREIGN PATENT DOCUMENTS

| | | |
|---|---|---|
| DE | 44 30 738 | 5/1995 |
| DE | 295 16 148 | 1/1996 |
| EP | 0 247 974 | 2/1987 |
| EP | 0 208 942 | 4/1990 |
| EP | 0 635 337 A2 | 7/1994 |
| FR | 2 635 998 | 3/1990 |
| GB | 1142073 | 2/1969 |
| GB | 2 264 062 A | 2/1992 |
| GB | 2 274 615 A | 1/1993 |
| IT | 518514 | 1/1953 |
| JP | 40-12195 | 1/1965 |
| JP | 50-45291 | 4/1975 |
| JP | 54-160952 | 1/1979 |
| JP | 55-37165 | 3/1980 |
| JP | 57-157487 | 9/1982 |
| JP | 61-38876 | 8/1986 |
| JP | 61-175379 | 8/1986 |
| JP | 63-165037 | 7/1988 |
| JP | 01188285 A | 7/1989 |
| JP | 2-37044 | 1/1990 |
| JP | 3-5633 | 1/1991 |
| JP | 3-19037 | 1/1991 |
| JP | 3-109778 | 1/1991 |
| JP | 03162917 A | 7/1991 |
| JP | 4-51379 | 1/1992 |
| JP | 5-53869 | 3/1993 |
| JP | 6-39402 | 2/1994 |
| JP | 6-85778 | 3/1994 |
| SU | 1036524 | 8/1983 |
| SU | 1174253 | 3/1984 |
| SU | 1105303 | 7/1984 |
| SU | 1648754 A1 | 5/1991 |

OTHER PUBLICATIONS

Stanley–Goldblatt Product Catalog, Feb. 1998.
Wal–Board Product Information Sheets, Unknown.
Wal–Board Price Lists and Product Information, Jun. 1, 1963.
Wal–Board Drywall Taping Tools Price List, Unknown.
Wal–Board Drywall Tools Product Information.
Wal–Board Price List, Aug. 15, 1967.
Wal–Board Tool Catalog, Unknown.
Wal–Board Tool Catalog (No. 21), unknown.
Wal–Board Tool Catalog (No. 26), unknown.
Wal–Board Tool Catalog (No. 27), unknown.
Wal–Board Tool Catalog, Unknown.
Wallboard Tool Catalog (No. 29), unknown.
Wal–Board Tool Catalog (No. 33), unknown.
Wallboard EK Taping Knife Handle Drawing (in folder), unknown.
Wal–Board Tuff Grip Taping Knife Labels, Unknown.
Wal–Board Product Photos, Unknown.
SAW Catalog and Product Photos, Unknown.
"Work Design: Industrial Ergonomics," Second Edition By Stephan Konz, 1983.
"Dem Maurer in die Hand geformt:", Unknown.
Marshalltown, 3, 5, 6, 9, 26,27, M0193Catalog 103, Unknown.
Trademark Reg. No. 1,908,181 and application papers, unknown.
Goldblatt Dealer Net Pricing Information, Jan. 13, 19992, 4 pages.
Goldblatt information, 1993, 9 pages.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3–19 is confirmed.

Claim 2 is cancelled.

Claims 1 and 20 are determined to be patentable as amended.

Claim 21, dependent on an amended claim, is determined to be patentable.

1. A [tapping]*taping* knife, comprising:

a blade member having a working blade region and a blade securement region*, said blade member having a proximal end and a distal end, said distal end of said blade member including a blade-mounting hole*;

an elongated handle secured to said blade member in said securement region and extending distally from said blade member along the line of gripping, said handle including[,]

(i) an inner member formed from a first plastic material, said inner member having distal and proximal ends; and (ii) an outer grip member formed of a second plastic material which surrounds a portion of said inner member to form a grippable area, said securement region including a backing plate secured to said blade *member* and said handle being secured to said backing plate*, said backing plate including*

(*i*) *a proximal end and a distal end;*

(*ii*) *a blade-receiving slot which bifurcates lengthwise said proximal end of said backing plate, said slot receiving said distal end of said blade member and said slot extending to encompass said blade-mounting hole;*

(*iii*) *a stampable area adjacent said blade-mounting hole which can be engaged with said blade-mounting hole to secure said blade member to said backing plate; and*

(*iv*) *at least one backing plate mounting hole in said distal end of said backing plate.*

20. A taping knife, comprising:

a blade member having a working blade region [and]*, said blade member having a proximal end and a distal end, said distal end of said blade member including a blade-mounting hole;* a blade securement region*, said securement region including a backing plate secured to said blade member, said backing plate including*

(*i*) *a proximal end and a distal end;*

(*ii*) *a blade-receiving slot which bifurcates lengthwise said proximal end of said backing plate, said slot receiving said distal end of said blade member and said slot entending to encompass said blade-mounting hole;*

(*iii*) *a stampable area adjacent said blade-mounting hole which can be engaged with said blade-mounting hole to secure said blade member to said backing plate; and*

(*iv*) *at least one backing plate mounting hole in said distal end of said backing plate;* an elongated handle secured to said [blade member in said securement region] *backing plate* and extending distally from said blade member along the line of gripping, said handle including[,]

(i) an inner member formed from a first plastic material, said inner member having distal and proximal ends; and (ii) an outer grip member formed of a second plastic material which is molded about a portion of said inner member to form a grippable area, said inner member including multiple component parts, said component parts being secured together by said outer grip member.

* * * * *